US006647932B1

(12) United States Patent
Cui et al.

(10) Patent No.: US 6,647,932 B1
(45) Date of Patent: Nov. 18, 2003

(54) COMPACT BOILER WITH TANKLESS HEATER FOR PROVIDING HEAT AND DOMESTIC HOT WATER

(75) Inventors: Shuqing Cui, Valparaiso, IN (US); Neil Rolph, LaPorte, IN (US); Ayman Abdel-Rehim, Michigan City, IN (US)

(73) Assignee: United Dominion Industries, Inc., Charlotte, NC (US)

( * ) Notice: Subject to any disclaimer, the term of this patent is extended or adjusted under 35 U.S.C. 154(b) by 0 days.

(21) Appl. No.: 10/175,889

(22) Filed: Jun. 21, 2002

(51) Int. Cl.[7] ..... F22B 31/04

(52) U.S. Cl. ..... 122/33; 122/406.1; 122/450

(58) Field of Search ..... 122/13.01, 33, 122/36, 40, 406.1, 446, 448.1, 450; 126/361.1, 362.1; 165/145, 165, 176, 181

(56) References Cited

U.S. PATENT DOCUMENTS

| | | | | | |
|---|---|---|---|---|---|
| 3,968,346 | A | * | 7/1976 | Cooksley | 392/491 |
| 4,251,028 | A | * | 2/1981 | Nicolai et al. | 237/8 R |
| 4,738,394 | A | * | 4/1988 | Ripka et al. | 236/20 R |
| 4,823,770 | A | * | 4/1989 | Loeffler | 122/15.1 |
| 4,848,655 | A | * | 7/1989 | Woodin et al. | 237/8 R |

* cited by examiner

*Primary Examiner*—Gregory Wilson
(74) *Attorney, Agent, or Firm*—Baker & Hostetter, L.L.P.

(57) ABSTRACT

A small and compact boiler for providing hot water for indoor heating and domestic hot water and method of operation are provided. The boiler includes a three way valve configured to circulate boiler water through a heating circuit when indoor heat is required, and bypass the heating circuit and circulate the boiler water through the heat exchanger to enable production of domestic hot water.

14 Claims, 4 Drawing Sheets

COMPACT BOILER WITH TANKLESS HEATER FOR PROVIDING HEAT AND DOMESTIC HOT WATER

FIELD OF THE INVENTION

The present invention relates generally to boilers. More particularly, the present invention relates to a compact boiler with tankless heater for providing both indoor heat and domestic hot water.

BACKGROUND OF THE INVENTION

Two primary uses for boilers in residential buildings include providing domestic hot water (DHW) and providing hot water for indoor heat. Typical boilers can do this in several ways. Two of these ways include, a boiler and an indirect water configuration, and a boiler with tankless heater configuration. Normally, the indirect water heater has DHW storage tank built in to it.

In the boiler and indirect water heater system, the closed boiler and piping system is initially filled with cold water from a water source, such as municipal water supply or well water. The boiler heats the water, and outputs hot water. The hot water output of a boiler is configured in two circuits. A pump or automatic valve(s) are employed to divert hot water from the boiler to either circuit. Space heating is accomplished by flowing hot water through a loop in the circuit which includes a radiator or other device for transferring heat out of the hot water and into air.

If the controller calls for more DHW, the hot water from a boiler is diverted to an indirect water heater to heat up the municipal water. The cooled down boiler water flows back to boiler. The DHW is stored in the tank until it can be used for various domestic hot water uses such as showers, laundry, dishwashers, and any other residential or commercial need for hot water. This type of system requires a lot of room because the boiler, the circuit, and the storage tank must be stored.

Another option includes producing hot boiler water for indoor heat and also DHW. A typical boiler will include a heat exchanger including a coil which may be made of thin copper tubing rolled into a compact circular shape. It is inserted into a chamber in the boiler where it is surrounded by water. The water surrounding the copper tubing is referred to as boiler water or system water. Cold water from a water source such as municipal or well water is drawn through the coil. The water flowing through the coil is often used for DHW.

A heat source, such as hot gases generated by burning fuel, or an electronic heat source applies heat to the boiler water. The boiler water then transfers heat to the DHW. In a typical boiler, with a tankless heater, a relatively large amount of boiler water surrounds the copper coil, and as heat is transferred to the DHW from the boiler water, the boiler water cools. The cooling effect generates a natural current in the boiler water which permits cool boiler water to flow away from the copper coil and hot boiler water to flow toward the copper coil. The natural current is an important factor in efficiently heating the DHW. A relatively large reservoir of boiler water is required to produce the natural current. Typical dimensions for a boiler of this type which can make about 3 gallons per minute of domestic hot water are 22 inches wide, 40 inches high, and 39 inches deep.

A second characteristic many conventional boilers with tankless heaters have is a heavy weight. By having a heavy boiler and large volume of boiler water, a large thermal mass sustains the heating for the DHW. As the DHW is heated, heat is removed from the boiler and the boiler water. If the boiler and boiler water cool too much as the DHW is heated, the heat transfer to the DHW looses efficiency and is hampered. A boiler that can make about 3 gallons per minute of DHW requires a typical boiler to weigh about 460 lbs.

There are some applications that require not only both space heating and DHW but also require compact or lightweight boiler. For example, installation space that was available for a boiler may only be about 22 inches wide, 28 inches high and 27 inches deep and require the boiler to generate about 3 gallons per minute of domestic hot water. Therefore, a small compact boiler is desired that can generate a similar amount of domestic hot water as larger and heavier boilers.

SUMMARY OF THE INVENTION

It is therefore a feature and advantage of the present invention to provide a smaller and/or lightweight boiler capable of providing similar performance characteristics as bigger and heavier boilers.

The above and other features and advantages are achieved through the use of a novel boiler as herein disclosed. In accordance with one embodiment of the present invention, a boiler is provided. The boiler includes a first heat exchanger configured to exchange heat between at least one first fluid and a heat source and a second heat exchanger configured as at least part of the first heat exchanger and configured to exchange heat between the first and a second fluid. The boiler also includes a first cold fluid intake configured to inlet the first fluid into the first heat exchanger and a second cold fluid intake configured to inlet the second fluid into the second heat exchanger. The boiler further includes a first hot fluid outlet configured to outlet the first fluid from the first heat exchanger a second hot fluid outlet configured to outlet the second fluid from the second heat exchanger and a three way valve configured to selectively divert fluid from at least one of the first hot fluid outlet and a circuit to the first cold fluid intake, wherein the three way valve provides fluid to the first cold fluid intake from at least one of a fluid source, directly from the first hot fluid outlet, and fluid that has circulated through the circuit.

In accordance with another embodiment of the present invention, a boiler is provided. The boiler includes: a first heat exchanger configured to exchange heat between at least one first fluid and a heat source and a second heat exchanger configured as at least part of the first heat exchanger and configured to exchange heat between at least the first and a second fluid. The boiler includes a first cold fluid intake configured to inlet the first fluid into the first heat exchanger and a second cold fluid intake configured to inlet the second fluid into the second heat exchanger. The boiler further includes a first hot fluid outlet configured to outlet the first fluid from the first heat exchanger, a second hot fluid outlet configured to outlet the second fluid from the second heat exchanger and means for selectively diverting fluid from the first hot fluid outlet to at least one of the first cold fluid intake; wherein the means for diverting fluid provides fluid to the first cold fluid intake from at least one of a fluid source, directly from the first hot fluid outlet, and fluid that has circulated through the circuit.

In accordance with another embodiment of the present invention, a method of exchanging heat between two fluids is provided. The method includes flowing a first and second fluid through a heat exchanger; directing the first fluid back through the heat exchanger when a controller detects a need to provide the second fluid; directing the first fluid through a circuit where a substantial portion of its heat is removed from the first fluid and then routing the first fluid back to the heat exchanger when the controller detects a need for hot fluid in the circuit.

There has thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF PREFERRED EMBODIMENTS OF THE INVENTION

Figure 1:
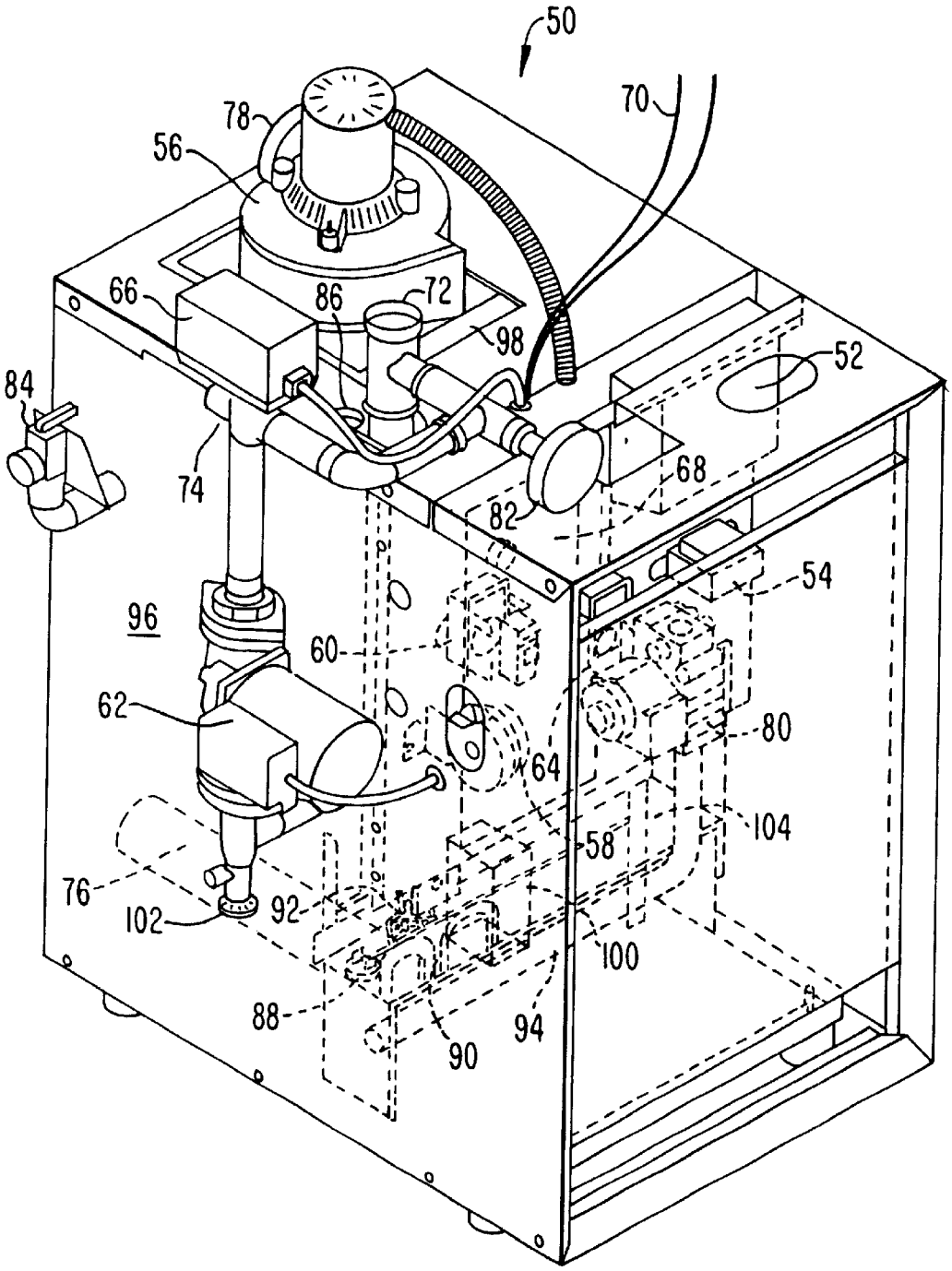
FIG. 1 is a perspective view of a see-through drawing of a boiler in accordance with the invention illustrating several components of a boiler.

Referring now to the figures, wherein like reference numerals indicate like elements, a preferred embodiment of the present invention provides a compact water boiler with a tankless heater. An optional embodiment of the present inventive apparatus is illustrated in FIG. 1. The boiler 50 shown in FIG. 1 is a gas fired boiler with tankless heater. However, other types of boilers such as electric or oil fired boilers may be used in accordance with the invention. The invention is in no way limited to tankless gas fired boilers.

As shown in FIG. 1, the boiler 50 includes a control module 52, a transformer 54, an inducer 56, an air pressure switch 58, a high limit sensor 60, a boiler circulator 62, a tankless heater lower limit 64, a three-way valve 66, a tankless heater 68, wires to ambient temperature switch 70. Other boiler components are also shown in FIG. 1 including a heating system supply 72, return from heating system 74, burners 76, flue outlet 78, gas valve 80, pressure temperature gage 82, relief valve 84, air vent connection 86, flame rollout thermal fuse element (TFE) 88, a burner holding bracket 90, a pilot burner bracket 92, gas manifold 94, boiler sections 96, flue collector 98, junction box 100, drain valve 102, and burner shield 104. Operation of gas fired water boilers are generally well known in the art and therefore will not be described herein in detail. What will be described in detail are those aspects of a boiler that are in accordance with the present invention.

Figure 2:
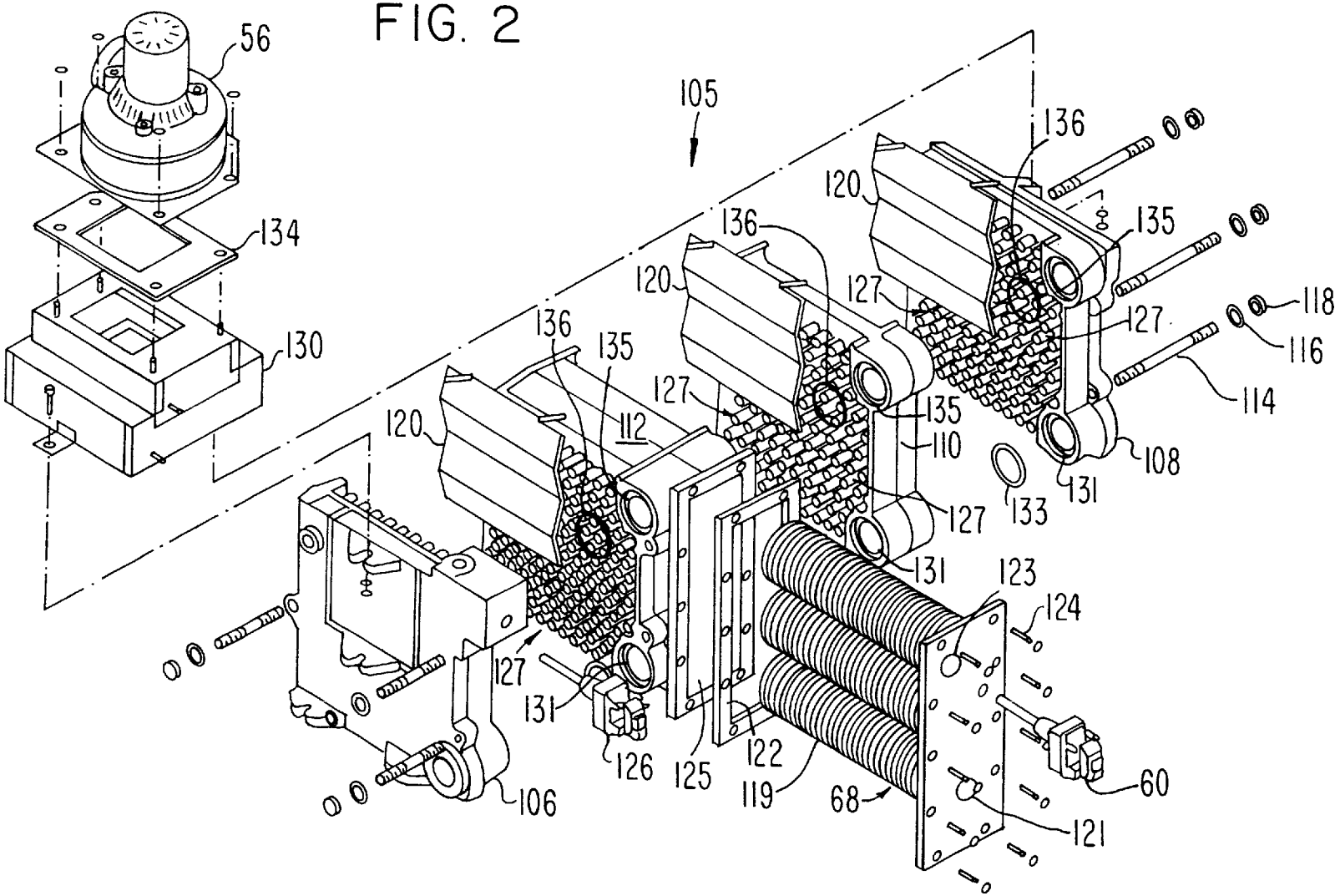
FIG. 2 is an exploded view of the heat exchanger in a tankless boiler.

The tankless water heater 68 of FIG. 1, is inserted in a heat exchanger 105 as shown in exploded view in FIG. 2. The heat exchanger 105 includes four sections a left end section 106, a right end section 108, and two intermediate sections 110 and 112. The four sections are attached together by tie rods 114, secured with washers 116, and nuts 118. When configured within a boiler 50, the heat exchanger 105 is located above the burners 76.

Hot gases generated by the combustion of fuel, such as natural gas, in the burners 76 pass up through the heat exchanger 105. The flow of the gases is slowed down by radiation plates 120 which slow the gases enough to provide the gases time to exchange heat into the heat exchanger 105. Transfer of heat from the gases to the boiler water located in the sections 106, 108, 110, and 112 is facilitated by heat transfer pins 127 located on the sections 106, 108, 110, and 112. The gases are vented out through a flue. The inducer fan 56 provides the flow to blow the gases out the flue. The inducer fan 56 is mounted to a collector hood 130 and via a gasket 134.

A tankless heater 68 is used to heat the DHW. The tankless heater 68 is made of thin heat conductive coiled tubing 119. Optionally, the tubing 119 may be metal such as copper. While the apparatus including sections 106, 108, 110, 112, and is considered a heat exchanger 105, tankless heater 68 may also be considered a heat exchanger. The tankless heater 68 fits within a chamber 125 within intermediate section 112. The tankless heater 68 is secured within intermediate section 112 by a stud and nut assembly 124. A gasket 122 is provided to provide a seal between the tankless heater 68 and the section 112. The chamber 125 is filled with boiler water and surrounds the tubing 119. The boiler water provides heat through the tubing 119 to the DHW. The DHW enters the tubing 119 through port 121, is heated as it flows through the tubing and exits through port 123.

As described above, the boiler water is heated in the heat exchanger 105 by a heat source. In the illustrated embodiment, the heat source is hot gases generated by combustion, but the heat source could be any number means used for heating. The system or hot boiler water circulates between the sections 106, 108, 110, and 112 via connections 131 at the bottom of each section and also connections 135 at the top of each section. A circulator 62 provides the circulation of the boiler water. Gaskets 133 and 136 may be provided to seal the connections between each section 106, 108, 110 and 112. By circulating the system or boiler water between each section, heat is able to be transferred into the tankless heater 68 located in section 112.

As DHW is generated by circulating water through the tubing 119 of the tankless heater 68, the hot boiler water in sections 112 will cool. The cooling of boiler water in section 112 is a result of heat being transferred from the boiler water within section 112 to the DHW.

Heat is transferred away from the boiler water in section 112 to the DHW in the tankless heater 68. To ensure that the boiler water in section 112 does not cool too much, and thus lose its effectiveness in transferring heat to the DHW, a way to circulate the boiler water between the sections 106, 108, 110, and 112, is provided as described above.

A benefit of circulating the water between the sections, is that a relatively small reservoir of boiler water such as the boiler water within section 112 may not be great enough to create a natural circulation. As previously mentioned, large reservoirs of water will naturally circulate as boiler water next to the tankless heater 68 cools and moves away from the tankless cooler. Boilers with smaller reservoirs of boiler water may not circulate naturally, but rather the water next to the tankless heater 68 will cool and the heat exchanger 105 may lose efficiency. In order to avoid this problem, the boiler water is circulated by a circulator 62 a mentioned above. By artificially circulating the boiler water, a fresh supply of hot boiler water is exposed to the tankless heater 68.

Figure 3:
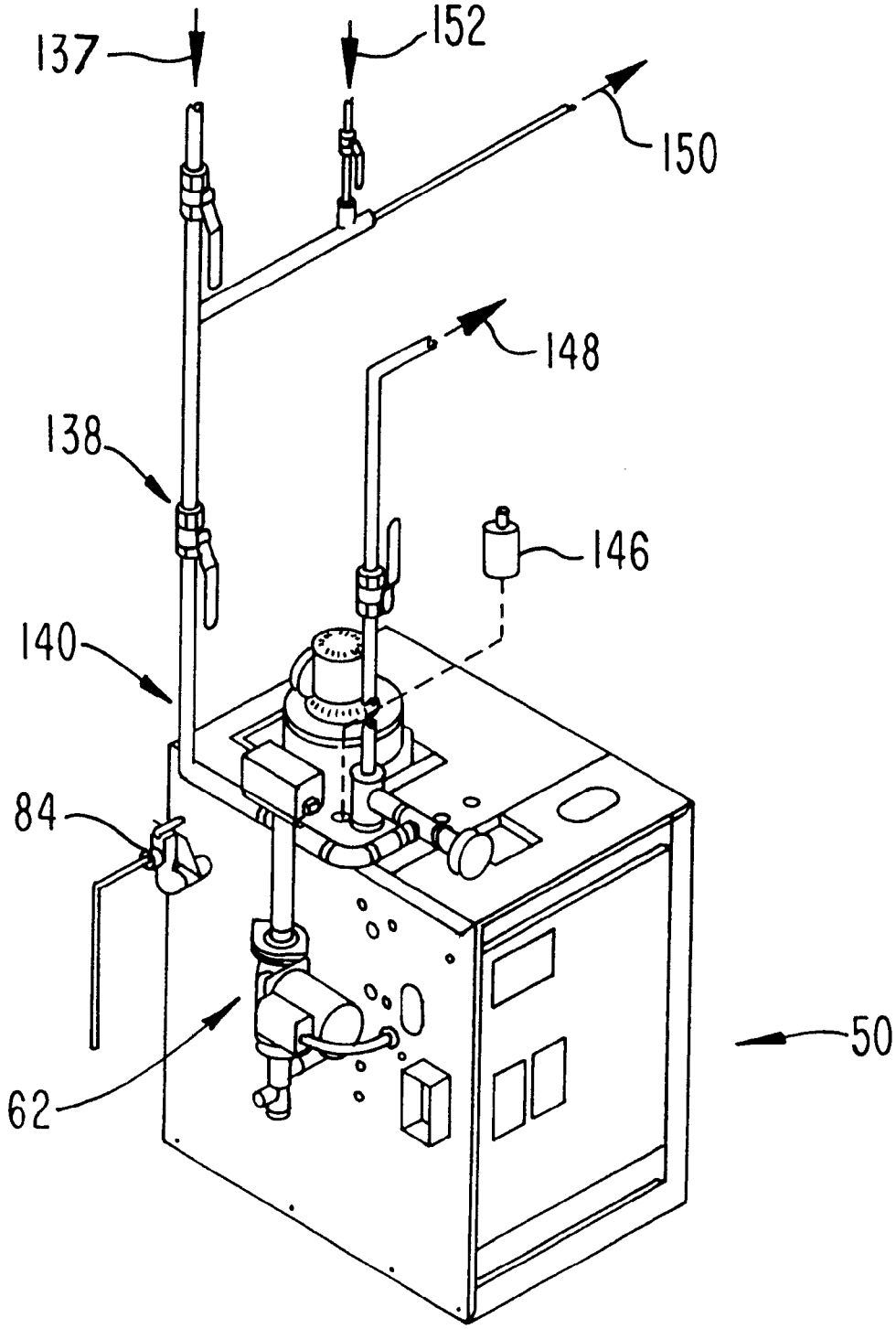
FIG. 3 is one optional example of a piping configuration associated with the boiler in accordance with the invention.

One optional way a boiler in accordance with the invention can be configured is to the piping system shown in FIG. 3. The system shown in FIG. 3 is exemplary only. Any particular system may be modified according to needs and requirements of a specific application. Arrow 137 shows the direction of the boiler water returning from the system circuit (not shown) used to harvest heat from the boiler water. This water is cool and is returning back to the boiler 50 for reheating. Isolation valve 138 is used for convenience of the system in isolating the boiler 50 for various reasons including maintenance. Return line 140 permits the boiler water to return to the boiler 50. The circulator 62 circulates the boiler water within the system circuit or loop. Arrow 148 shows the direction of the hot boiler water exiting from the boiler 50 to the system for providing heating, arrow 150 shows water going to an expansion tank (not shown), and arrow 152 shows where a water source can be used to fill the system for an initial fill, after the system has been drained, or in case the system is depleted due to leaks.

Hot boiler water exiting the heat exchanger 105 can go to one of two places. It can either flow into the heating circuit to be used for providing heating in the direction of arrow 148 or the hot boiler water can be sent back to the heat exchanger 105 and bypass the heating circuit entirely. The purpose for hot boiler water to bypass the circuit is to create DHW. The three-way valve 66 permits the bypass.

If DHW is called for, the boiler 50 may dedicate its entire heating capacity to the generation of DHW. By the nature of the configuration of the boiler, the heat from the heat source is transferred to the boiler water. Instead of using the heat in the boiler water to create indoor heating, the boiler water may be re-circulated to the tankless heater 68 rather than the heating loop. By circulating the boiler water to the tankless heater 68 the boiler water will transfer the heat it contains to the DHW rather than to the load in the heating circuit. This ability to bypass the heating circuit permits the boiler to dedicate substantially all of its heating capacity to generating DHW.

In some optional embodiments, a sensor 60 is located close to the tankless heater 68 in order to determine that a temperature within the tankless heater 68 is one of appropriate value. This sensor 60 may send a signal corresponding to the temperature within the tankless heater 68 to the controller 52. Based on signals sent by the sensors 60 the controller may operate three way valve 66 or provide DHW or hot water for the heat circuit whichever is desired. A second sensor 126 is provided attached to the left end section 106. This sensor 126 may detect the temperature of the hot boiler water within heat exchanger 105 and send a signal to the controller 52 to prevent boiler from overheating.

Figure 4:
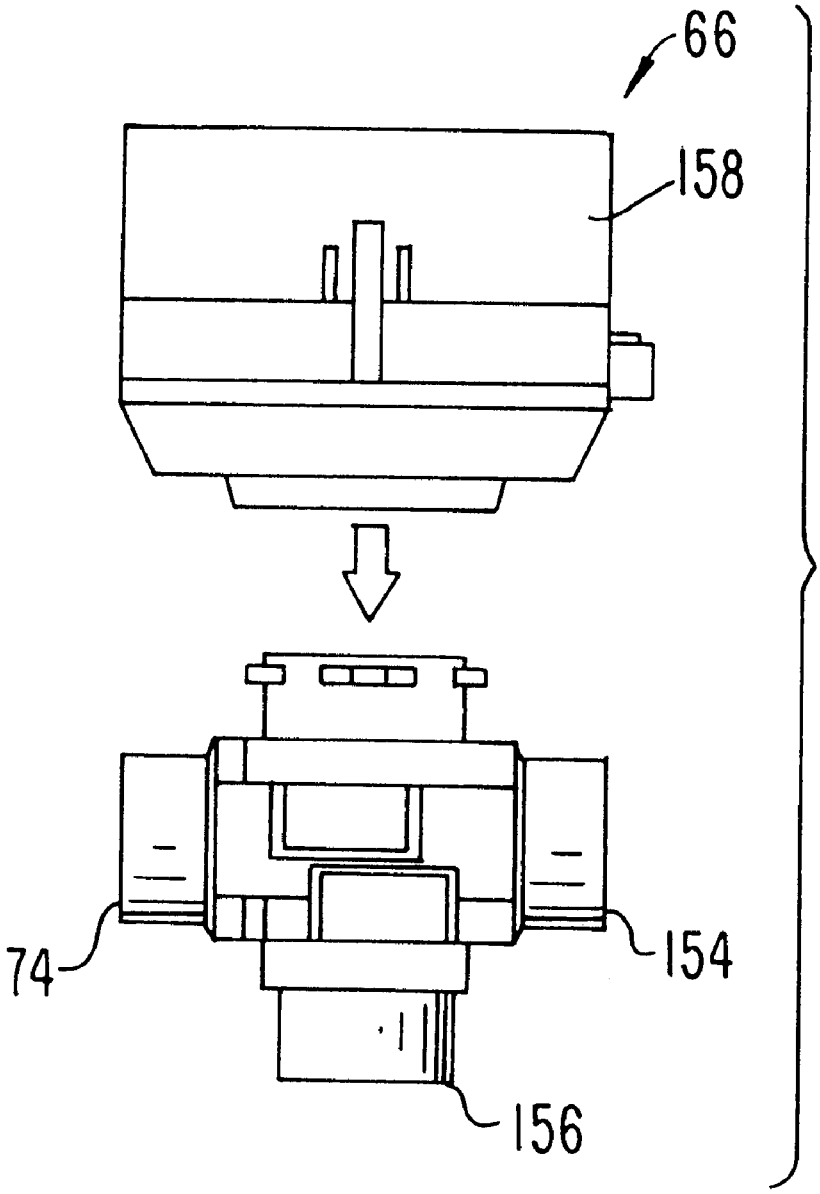
FIG. 4 is an exploded view of the three-way valve in accordance with the invention.

An exploded view of the three-way valve 66 is shown in FIG. 4. The three-way valve 66 is provided in accordance with the invention. One purpose of the three-way valve 66 is to permit the boiler 50 to dedicate its heating capacity in an efficient way, whether it is to provide heat to the boiler water for circulation in the circuit for indoor heat or to provide heat to DHW. Pipe 74 in the three-way valve 66 is the pipe through which the boiler water or system water returning from providing heat to the heating system returns back to the boiler 50. Pipe 156 directly feeds the system water to the heat exchanger 105.

Pipe 154 provides the pathway for the hot boiler water from the heat exchanger 105 to return back to the heat exchanger 105 for additional heating and generation of DHW. Water from the heat exchanger 105 flows through pipe 154 into the three-way valve 66 and flow through pipe 156 to the heat exchanger 105 for additional heating. Actuator 158 provides the selection in the three-way valve of where water flows either from pipe 74 into pipe 156 or from pipe 154 to pipe 156. The actuator 158 is controlled by the controller 52.

In accordance with the invention, some embodiments of the invention use two operation sequences. One is for generating hot boiler water for space heating, and the other is for generating DHW. Generating hot boiler water for space heating is done when the boiler 50 is given a call for space heating heat. The call for heat is usually done by a thermostat (not shown). The three-way valve 66 will be in position to allow water to pass from pipe 74 into pipe 156. The control module 52 will supply power to the inducer fan 56 for purging residual gases through the exchanger 105 and flue, and the circulator 62 will circulate hot water to the heating system. The pressure switch contact 58 is closed to prove there is proper air flow for combustion. The control module 52 will generate a spark to the pilot burner 92. Once the pilot burner ignition is established, the spark generation turned off and a flame sensor senses the pilot flame and the main gas valve 80 opens, the main burners 76 will establish full ignition. The control module 52 will maintain the boiler 50 in operation until the room thermostat is satisfied and sends a signal that no more hot boiler water is required to generate room heating.

The other operation sequence is to provide DHW. The sensor 60 is located close to the tankless water heater coil 119. When a DHW faucet is opened the sensor 60 will sense a demand for DHW. The three-way valve 66 will move from its position of permitting water to flow from pipe 74 to pipe 156 to bypass the hot water heating circuit and have hot boiler water flow from pipe 154 into pipe 156. The control module 52 will supply power to the inducer fan 56 for purging, the residual gasses and the circulator 62 will circulate water through the heat exchanger 105. The pressure switch contact 58 is closed to prove there is the proper air flow. The control module 52 will generate a spark to the pilot burner 92. Once the pilot burner ignition is established and spark generators turned off and the flame sensor senses a pilot flame and the main gas valve 80 opens, the main burners 76 will establish full ignition. The control module 52 will maintain the boiler 50 in operation until the sensor 60 is satisfied, then the three-way valve 66 will move back to the position via the actuator 158 to transfer boiler water from pipe 74 to pipe 156.

A difference between the space heating and the DHW heating operation sequences is that the DHW heat call requires that the three-way valve 66 changes positions and does not allow the system boiler water to go through the heat circuit, but rather utilizes all of the boiler thermal capacity to supply as much heat as possible to generating DHW.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A boiler for providing a hot fluid comprising:

a first heat exchanger configured to exchange heat between at least one first fluid and a heat source and having a first cold fluid intake configured to inlet the first fluid into the first heat exchanger and a first hot fluid outlet configured to outlet the first fluid from the first heat exchanger;

a second heat exchanger configured as at least part of the first heat exchanger and configured to exchange heat between the first and a second fluid and having a second cold fluid intake configured to inlet the second fluid into the second heat exchanger and a second hot fluid outlet configured to outlet the second fluid from the second heat exchanger; and a three way valve configured to selectively divert fluid from at least one of the first hot fluid outlet and a circuit to the first cold fluid intake, and wherein the three way valve also provides fluid to the first cold fluid intake from at least one of a fluid source, directly from the first hot fluid outlet, and fluid that has circulated through the circuit.

2. The boiler of claim 1, further comprising a sensor configured to sense a temperature associated with the second hot fluid outlet and send a signal to a controller when the temperature associated with the second hot fluid outlet is below a predetermined level, and wherein the controller operates the three way valve to divert at least some fluid from the first hot fluid outlet to the first cold fluid inlet.

3. The boiler of claim 2, wherein the sensor is further configured to send a signal to the controller when the temperature associated with the second hot fluid outlet is above a predetermined level, and wherein the controller shuts down heating elements in the boiler.

4. The boiler of claim 1, wherein the boiler is gas fired.

5. The boiler of claim 1, further comprising a sensor configured to sense a temperature associated with the first fluid in the first heat exchanger and send a signal to the controller when the temperature associated with the first fluid in the first heat exchanger is above a predetermined level, and wherein the controller shuts down heating elements in the boiler.

6. The boiler of claim 1, wherein fluid exiting the first hot fluid outlet circulates selectively in one of a circuit to provide residential building heat and a bypass for the circuit and is applied directly back to the first heat exchanger via the first cold fluid inlet.

7. The boiler of claim 1, wherein fluid exiting the second hot fluid outlet is domestic hot water and the fluid applied to the second heat exchanger via the second cold fluid input comes from a municipal water source.

8. A boiler for providing a hot fluid comprising:

a first heat exchanger configured to exchange heat between at least one first fluid and a heat source having a first cold fluid intake configured to inlet the first fluid into the first heat exchanger and a first hot fluid outlet configured to outlet the first fluid from the first heat exchanger;

a second heat exchanger configured as at least part of the first heat exchanger and configured to exchange heat between the first and a second fluid, the second heat exchanger having a second cold fluid intake configured to inlet the second fluid into the second heat exchanger and a second hot fluid outlet configured to outlet the second fluid from the second heat exchanger; and means for selectively diverting fluid from the first hot fluid outlet to at least one of the first cold fluid intake and a circuit, and wherein the means for diverting fluid provides fluid to the first cold fluid intake from at least one of a fluid source, directly from the first hot fluid outlet, and fluid that has circulated through the circuit.

9. The boiler of claim 8, further comprising a sensor configured to sense a temperature associated with the second hot fluid outlet and send a signal to a controller when the temperature associated with the second hot fluid outlet is below a predetermined level, and wherein the controller operates the means for diverting fluid to divert at least some fluid from the first hot fluid outlet to the first cold fluid inlet.

10. The boiler of claim 9, wherein the sensor is further configured to send a signal to the controller when the temperature associated with the second hot fluid outlet is above a predetermined level, and wherein the controller operates means for diverting fluid to provide fluid to the first cold fluid inlet from at least one of a fluid source and fluid that has circulated through a circuit.

11. The boiler of claim 8, wherein the boiler is gas-fired.

12. The boiler of claim 8, further comprising a sensor configured to sense a temperature associated with the first fluid in the first heat exchanger and send a signal to the controller when a temperature associated with the first fluid in the first heat exchanger is above a predetermined level, and wherein the controller turns off heating elements associated with the boiler.

13. The boiler of claim 8, wherein fluid exiting the first hot fluid outlet circulates selectively in one of a circuit to provide residential building heat and a bypass for the circuit and is applied directly back to the first heat exchanger via the first cold fluid inlet.

14. The boiler of claim 8, wherein fluid exiting the second hot fluid outlet is domestic hot water and the fluid applied to the second heat exchanger via the second cold fluid input comes from a municipal water source.

* * * * *